US011666796B2

(12) United States Patent
Ott

(10) Patent No.: US 11,666,796 B2
(45) Date of Patent: Jun. 6, 2023

(54) FLAT STRAP PULLEY

(71) Applicant: Wolfgang Ott, Antioch, CA (US)

(72) Inventor: Wolfgang Ott, Antioch, CA (US)

( * ) Notice: Subject to any disclaimer, the term of this patent is extended or adjusted under 35 U.S.C. 154(b) by 314 days.

(21) Appl. No.: 17/024,320

(22) Filed: Sep. 17, 2020

(65) Prior Publication Data

US 2021/0123517 A1 Apr. 29, 2021

Related U.S. Application Data

(60) Provisional application No. 62/902,765, filed on Sep. 19, 2019.

(51) Int. Cl.
*A63B 21/00* (2006.01)

(52) U.S. Cl.
CPC ..... *A63B 21/154* (2013.01)

(58) Field of Classification Search
CPC ... A63B 21/012; A63B 21/015; A63B 21/018; A63B 21/08; A63B 21/15; A63B 21/151; A63B 21/154; A63B 21/155; A63B 21/156; A63B 21/04; A63B 21/0421; A63B 21/0428; A63B 21/0435; A63B 21/0442; F16H 55/36; F16H 55/52; F16H 55/54; F16H 55/56; F16H 55/566
See application file for complete search history.

(56) References Cited

U.S. PATENT DOCUMENTS

| | | | | |
|---|---|---|---|---|
| 9,764,177 | B2 * | 9/2017 | Baudhuin | A63B 21/068 |
| 2014/0299411 | A1 * | 10/2014 | Aldred | A62B 1/10 254/390 |
| 2015/0090196 | A1 * | 4/2015 | Fleming | A01K 27/003 119/795 |
| 2017/0014665 | A1 * | 1/2017 | Bowles | A63B 21/4013 |
| 2017/0157448 | A1 * | 6/2017 | Shavell | A63B 21/08 |
| 2019/0217141 | A1 * | 7/2019 | Ott | A63B 21/4043 |
| 2021/0069531 | A1 * | 3/2021 | Katznelson | A62B 1/14 |
| 2021/0244995 | A1 * | 8/2021 | Andrei | A63B 21/1663 |
| 2021/0322813 | A1 * | 10/2021 | Lagree | A63B 21/22 |
| 2022/0288431 | A1 * | 9/2022 | Hedé | A62B 1/10 |
| 2022/0289264 | A1 * | 9/2022 | Partsch, IV | B62B 5/069 |
| 2022/0293906 | A1 * | 9/2022 | Mimura | H01M 4/0404 |

* cited by examiner

*Primary Examiner* — Loan B Jimenez
*Assistant Examiner* — Zachary T Moore
(74) *Attorney, Agent, or Firm* — Steven R. Vosen

(57) ABSTRACT

A pulley in a housing designed for use with a flexible flat strap in which low friction movable guides in the pulley housing allow the flexible flat strap to enter, pass through and exit the housing through windows in the housing without the flexible flat strap jamming the pulley or being worn by contact with an edge of a housing window.

10 Claims, 10 Drawing Sheets

FLAT STRAP PULLEY

FIELD OF THE INVENTION

The present invention relates to pulleys and, more particularly, to pulleys having a pulley wheel within a housing for use with a flat strap. As used herein, the term "flat strap" and "strap" shall be understood to refer to a flexible, flat, elongated member having a width that is typically several times greater than its thickness and a cross-section that is generally rectangular, in contrast to a rope or cable which typically have generally circular or oval cross-sections.

BACKGROUND OF THE INVENTION

The use of a pulley with a strap has the challenge of keeping the strap from twisting or curling as it enters, for example, a free-to-rotate-about-its-own-axis pulley, thus jamming the pulley and/or causing undue wear on the strap.

The present invention provides a pulley for use with a strap that prevents such curling or strap deformation that would otherwise jam the pulley or cause excessive wear on the strap.

The present invention provides a pulley for use with a strap, the ends of which are free to rotate, for example, and without limitation, as in an exercise device, in which the pulley prevents curling or strap deformation that would otherwise jam the pulley or cause excessive wear on the strap.

A free-to-rotate pulley is commonly used with ropes and cables, as twisting of the rope or cable generally still allows an unhindered use of the pulley and does not easily lead to jamming of the pulley.

However, it is not possible with prior art pulleys to use a flat strap with a pulley wheel in a housing that is free to rotate where, in normal use, the strap may become twisted or otherwise deformed as it enters the housing without the strap causing a jam that stops the operation of the pulley and/or causes undue wear on the strap by friction contact with the housing.

SUMMARY OF THE INVENTION

The present invention provides a pulley wheel in a free-to-rotate housing for use with a flat strap wherein twisting or curling or other strap deformation that would otherwise jam the pulley or cause excessive wear on the strap by friction contact with the housing, or cause the strap to come off the pulley wheel, is prevented while keeping the flat strap properly aligned with and engaged on the pulley wheel.

In one embodiment of the invention, a pulley useful with a flat strap includes a pulley wheel enclosed within a housing wherein the pulley wheel supports the flat strap as it moves in and out of the housing. The housing has a first window and a second window by which the flat strap enters and exits the housing wherein the windows are wide enough to allow the flat strap to enter and exit the housing from a wide range of angles. A first strap guide having a slot is disposed within the housing adjacent the first window wherein the slot is dimensioned to have a cross-section slightly larger than the cross-section of the flat strap. A second strap guide having a slot is disposed within the housing adjacent the second window wherein the slot is dimensioned to have a cross-section slightly larger than the cross-section of the flat strap. The first and second guides are movable relative to their respective windows, enabling a flat strap to enter and exit the housing at an angle that aligns the strap with the pulley wheel. In addition, a twist or other deformation of the flat strap as it enters a housing window will be restored to its flatness and avoid causing the pulley to jam. Furthermore, the guides will prevent the flat strap from making abrasive contact with the housing. The guide openings are formed to have low friction contact surfaces to prevent undue wear on the strap.

In one embodiment, the surface of the pulley wheel that engages the flat strap is curved to further help to center the flat strap on the pulley wheel and to keep the flat strap from riding off of the pulley wheel.

In one embodiment, the slots in the guides have curved edges to further help to center the flat strap on the pulley wheel. The guides further keep the flat strap from engaging edges of the housing windows by the guides being positioned in raceways as determined by the angle at which the strap enters the housing window and limited by the ends of the raceways. The relationship between the dimensions of the windows, the guides, the slots and the raceways is such that the guides will be positioned in the raceways as a function of the angle in which the strap enters or exits the housing but be limited from assuming a position in the raceways that would permit the strap to engage and chafe against any edge of the housing windows.

These features, together with the various ancillary provisions and features which will become apparent to those skilled in the art from the following detailed description, are attained by the pulley of the present invention, preferred embodiments thereof being shown with reference to the accompanying drawings, by way of example only, wherein:

Reference symbols are used in the Figures to indicate certain components, aspects or features shown therein, with reference symbols common to more than one Figure indicating like components, aspects or features shown therein.

DETAILED DESCRIPTION OF THE INVENTION

Figure 1:
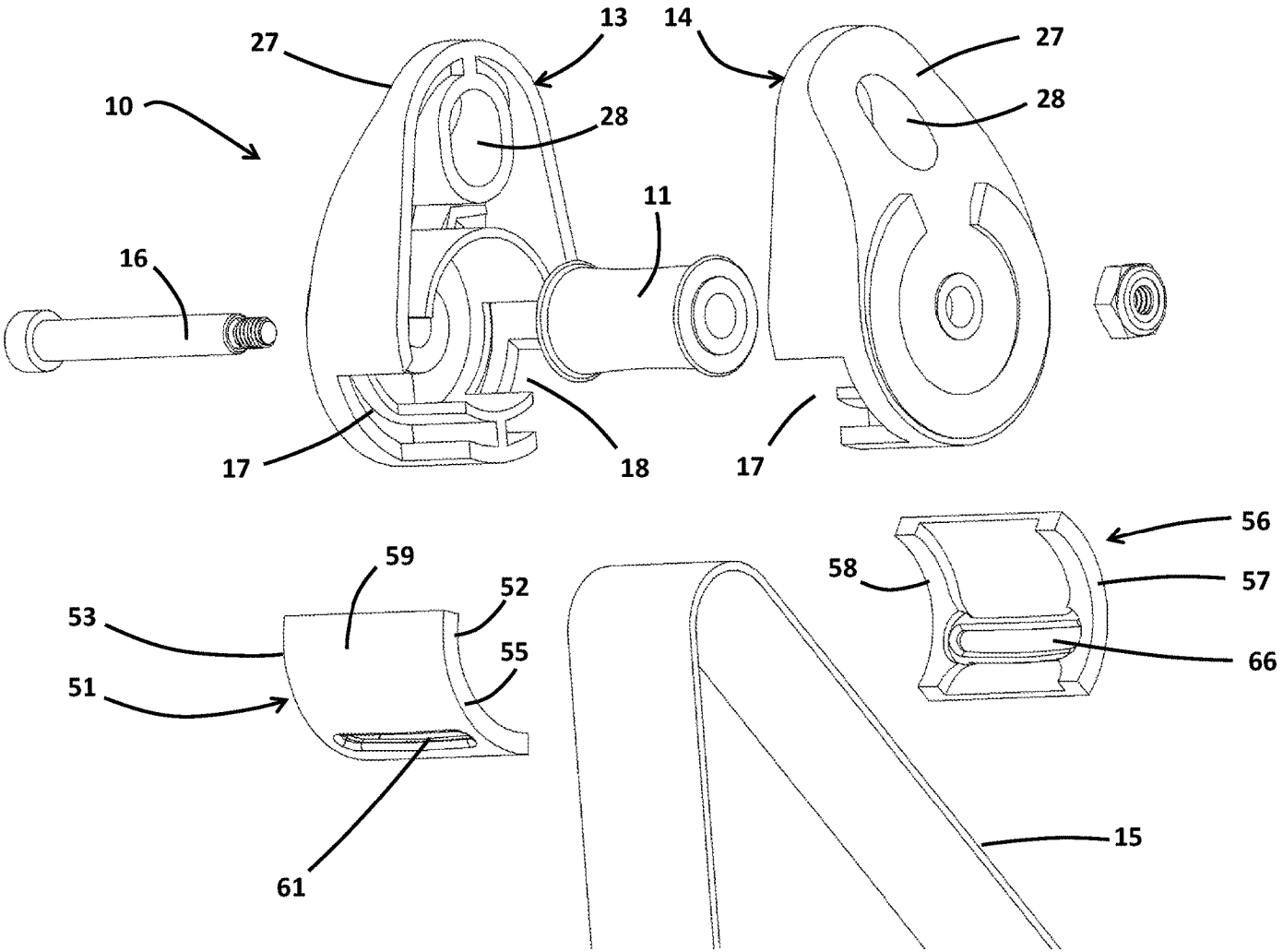
FIG. 1 is an exploded perspective view of one embodiment of the pulley of the invention illustrating its various components.
Figure 2:
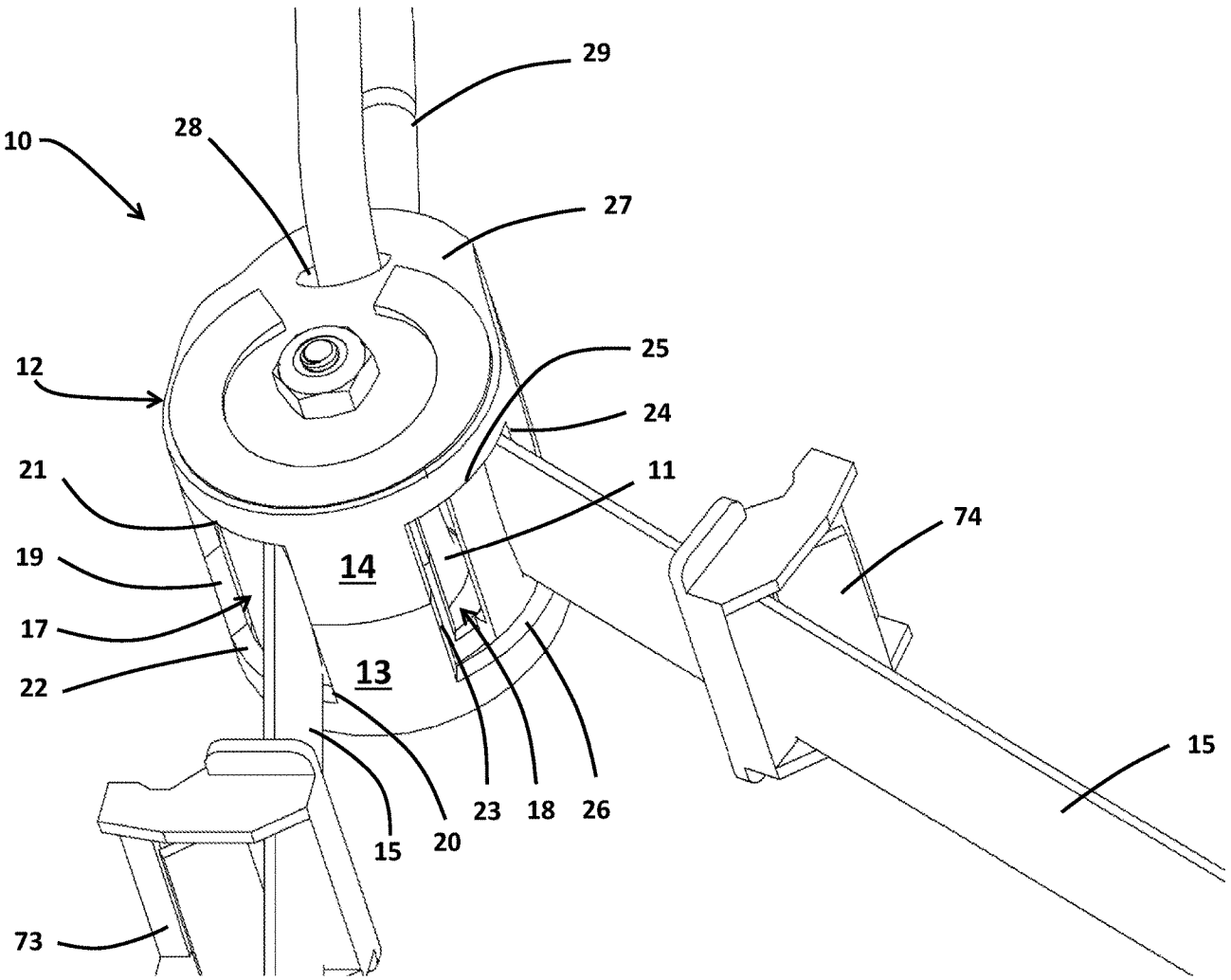
FIG. 2 is a bottom perspective view of the pulley invention of FIG. 1 with the components assembled.
Figure 3:
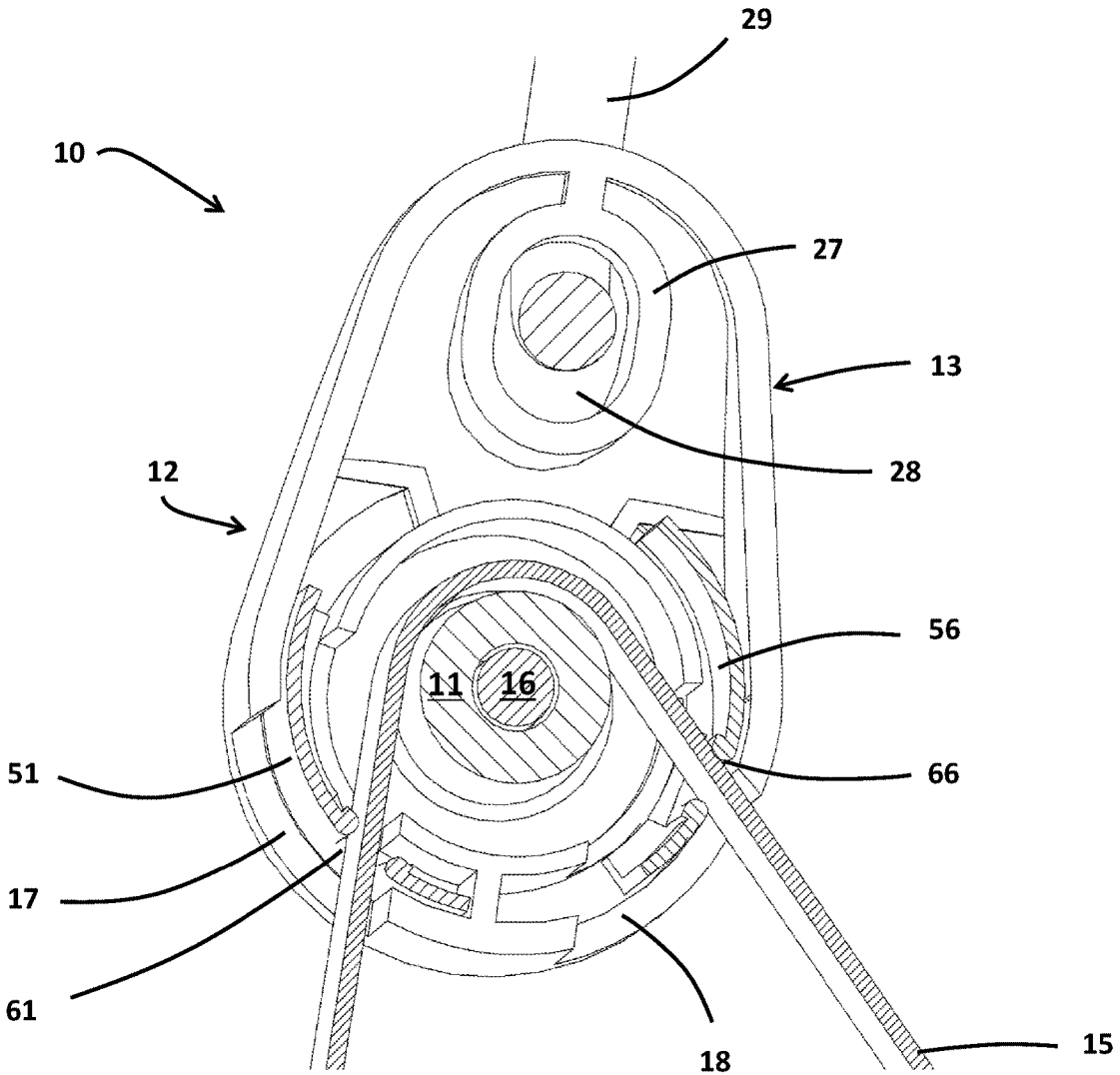
FIG. 3 is a perspective sectional view of the pulley invention of FIG. 1 revealing the interior of the assembled components.

Referring to FIGS. 1, 2 and 3, in one embodiment, a pulley 10 comprises a cylindrical pulley wheel 11 disposed in a housing 12 for support of a flat strap 15. Housing 12 comprises matching, mirror-image first housing member 13 and second housing member 14, which, when secured together as by a bolt 16, form, inter alia, a generally rectangular curved first window 17 and a generally rectangular curved second window 18 through which the strap 15 passes as it travels in and out of the housing 12 and over the pulley wheel 11.

Locking cam buckles 73 and 74 located on strap 15, are larger than windows 17 or 18 and thus blocked from entering the housing 12. Depending where cam buckles 73 and 74 are locked in place on strap 15, the length of strap 15 that can pass through the pulley 10 is limited to the length of strap between the cam buckles 73 and 74. By locking each cam buckle 73 and 74 up against housing 12, strap 15 can be locked in place, preventing any movement of strap 15 through the pulley 10.

First window 17 is defined by top edge 19 and spaced-apart bottom edge 20, first side edge 21 and second side edge 22 and a length between top edge 19 and spaced-apart bottom edge 20.

Second window 18 is defined by top edge 24, bottom edge 23, first side edge 25 and second side edge 26 and a length between top edge 24 and spaced-apart bottom edge 23.

The housing members 13 and 14, when joined (FIG. 2), form a connection member 27 having an aperture 28 for receiving a connector such as a carabiner 29 or a mounting strap (not shown) or the like that attaches the pulley 10 to a support structure (not shown) and permits it to rotate.

Figure 4:
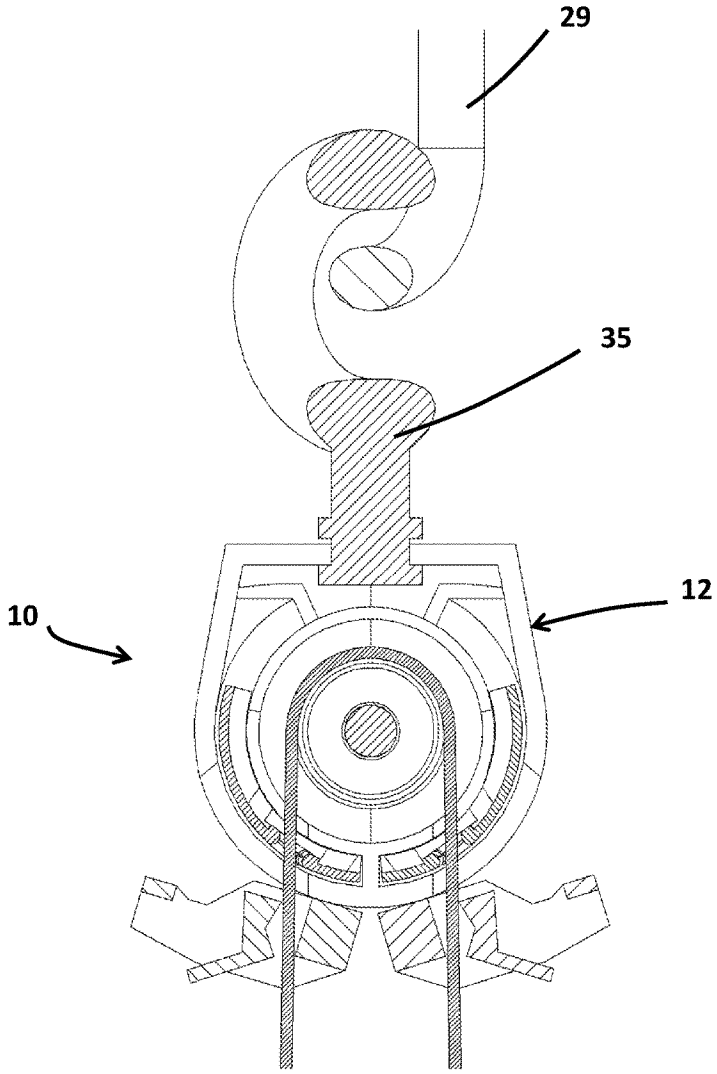
FIG. 4 is front sectional view illustrating a swivel connection for the pulley housing.

As illustrated in FIG. 4, in an alternative embodiment, the connection between the pulley 10 and a connector 29 (i.e., carabiner or another similar device) is by a swivel mechanism 35. In both embodiments, the pulley 10 is able to freely rotate-about its own axis or move in space as opposed to being fixed in one place.

Pulley wheel 11 is rotatably mounted within housing 12 on a shaft 16. In one embodiment, the pulley wheel 11 is generally cylindrical as shown, but the invention is not so limited as the pulley wheel can take other shapes. In operation, as strap 15 travels though the housing 12, it engages and is supported by pulley wheel 11.

Figure 5:
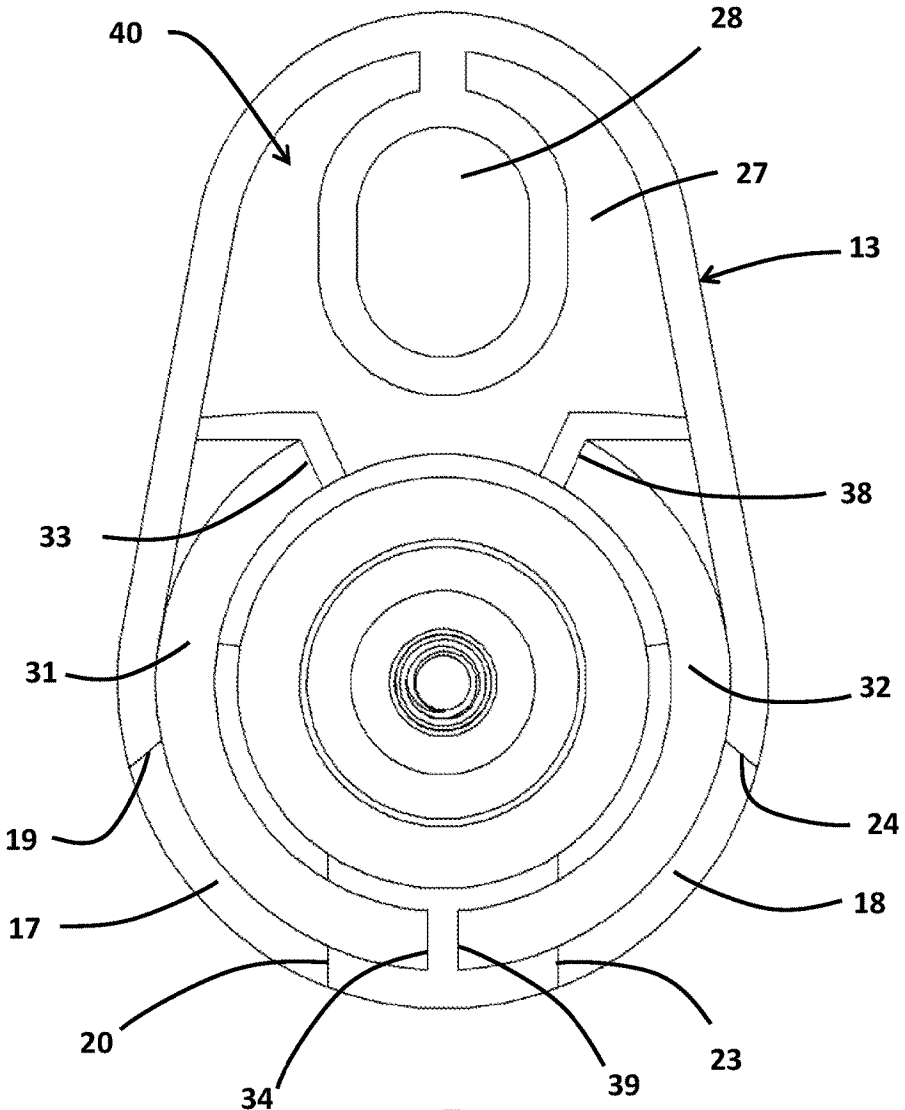
FIG. 5 is a front view of the interior structure of one the two housing members.
Figure 6:
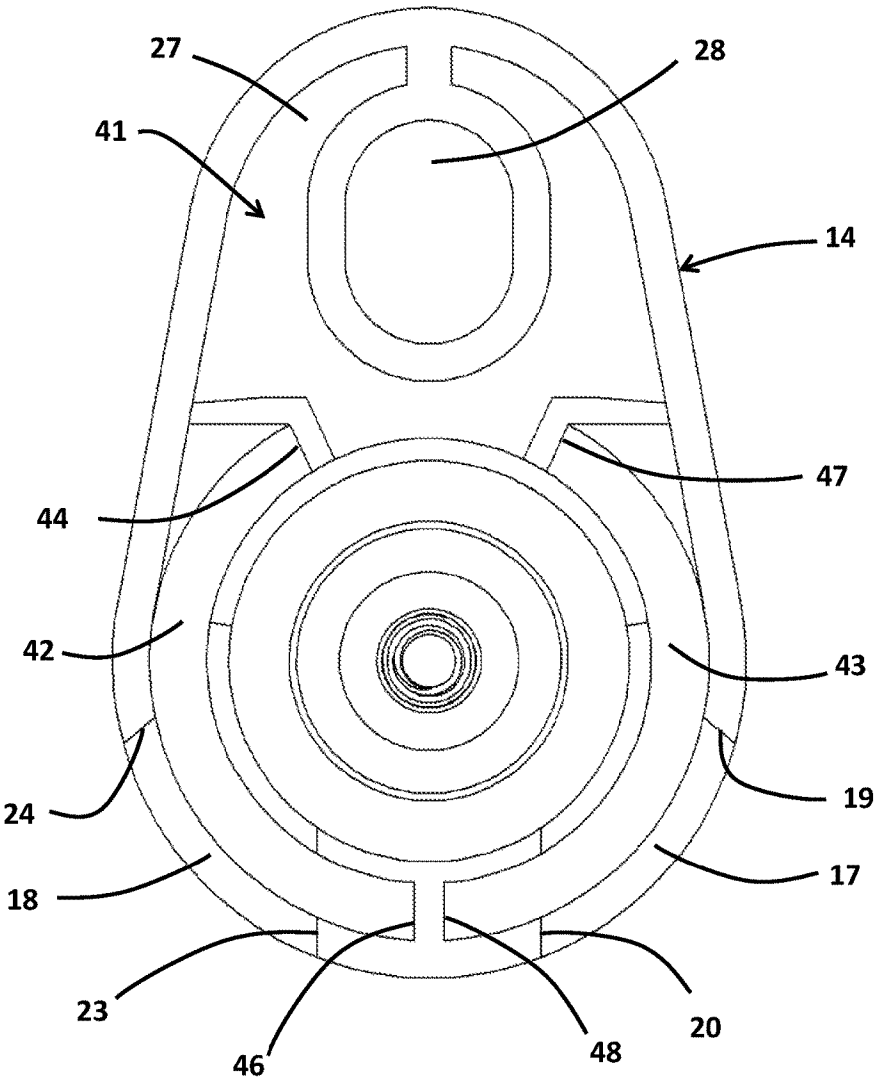
FIG. 6 is a front view illustrating the interior structure of the other of the two housing members.

Referring to FIGS. 5 and 6, the interior side 40 of first housing member 13 has a pair of arcuate raceways (channels) 31 and 32 formed therein. Arcuate raceway 31 is located adjacent to and follows the curve of first window 17 and terminates at opposite ends 33 and 34 which are located beyond the top 19 and bottom 20, respectively, of first window 17. Raceway 31 has a length between its ends 33 and 34.

Raceway 32 is located adjacent to and follows the curve of second window 18 and terminates in opposite ends 38 and 39 that are located beyond the top edge 24 and bottom edge 23, respectively, of second widow 18. Raceway 32 has a length between opposite ends 38 and 39.

The interior side 41 of second housing member 14 has a pair of arcuate raceways (channels) 42 and 43 formed therein. Arcuate raceway 42 is located adjacent to and follows the curve of second window 18 and terminates at opposite ends 44 and 46 which are located beyond top edge 24 and bottom edge 23, respectively, of second window 18. Raceway 42 has a length between its ends 44 and 46.

Raceway 43 is located adjacent to and follows the curve of first window 17 and terminates in opposite ends 47 and 48 that are located beyond bottom edge 20 and top edge 19, respectively, of first window 17. Raceway 43 has a length between its ends 47 and 48.

Referring to FIGS. 5 and 6, when first housing member 13 and second housing member 14 are joined (FIG. 2), windows 17 and 18 are formed and raceways 31 and 43 are in spaced-apart facing relationship adjacent window 17, and raceways 32 and 42 are in spaced-apart facing relationship adjacent window 18.

Referring to FIGS. 1, 3, and 5-9, a generally rectangular arcuate strap guide 51 has an edge 53 disposed in the raceway 31 of member 13 and its other edge 52 disposed in facing raceway 43 of housing member 14. The strap guide 51 has a length along its arc (between edges 62 and 63) that is less than the arcuate length of the raceways 31 and 43, allowing the strap guide 51 to move easily within the raceways 31 and 43 between the ends 33 and 34, and 47 and 48 thereof relative to the window 17.

Similarly, a strap guide 56 which is substantially identical to strap guide 51 has one edge 58 disposed in the raceway 32 of member 13 and its other edge 57 in facing raceway 42 of housing member 14. The strap guide 56 has a length along its arc (between edges 71 and 72) that is less than the arcuate length of the raceways 32 and 42, allowing the strap guide 56 to move easily within the raceways 32 and 42 between the ends 38 and 39, and 44 and 46 thereof relative to the window 18.

The strap guides 51 and 56 have an arcuate profile that matches the arc of raceways 31, 32, 42 and 43 whereby in the assembled pulley 10, the strap guides 51 and 56 can move freely along their respective raceways between the raceway ends relative to the windows 17 and 18.

Figure 8:
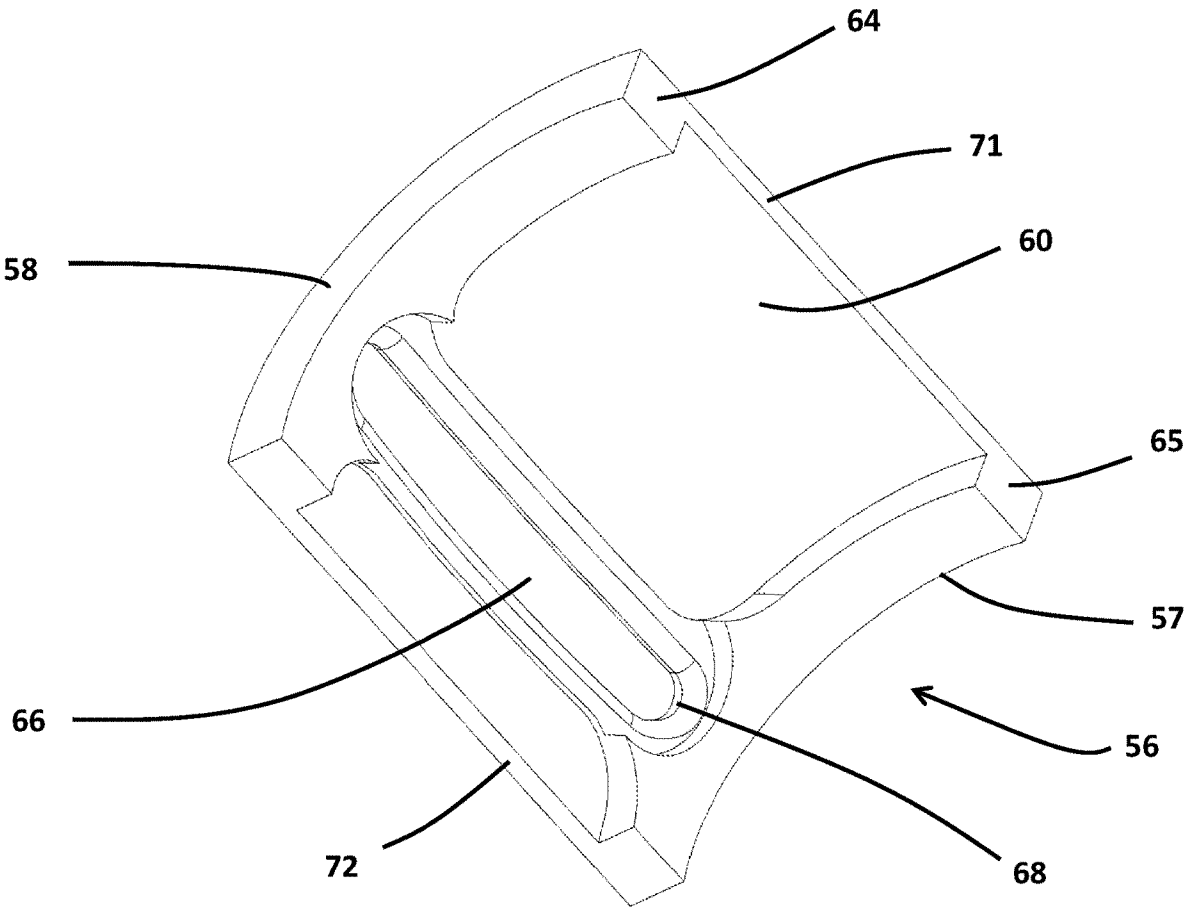
FIG. 8 is a rear perspective view of one of the two interior guides.
Figure 9:
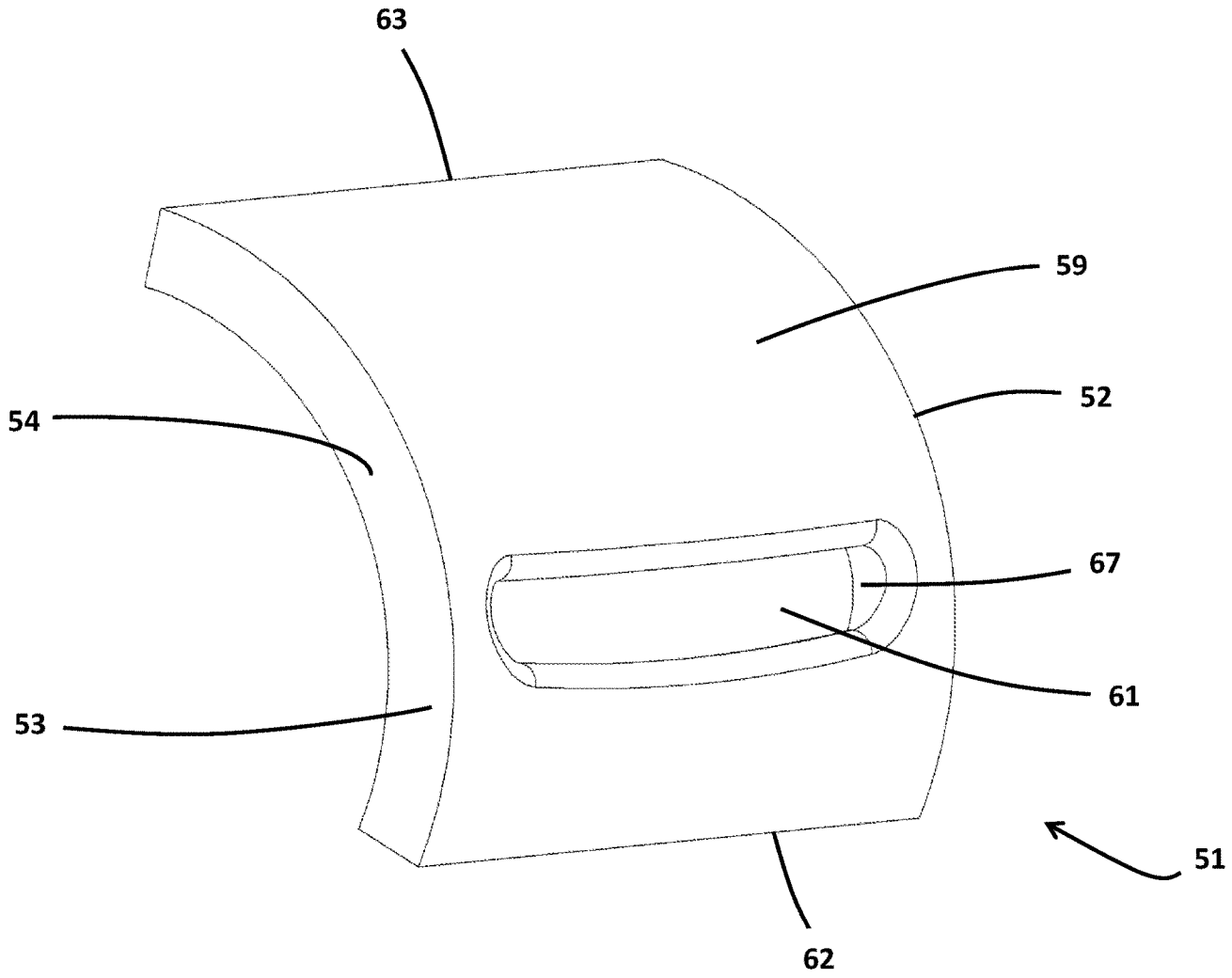
FIG. 9 is a front perspective view of the other of the two interior guides.

Referring to FIGS. 1, 8, and 9, arcuate strap guides 51 and 56 have formed therein a strap slot 61 and 66, respectively. These slots are dimensioned to be only slightly wider than the thickness of strap 15 and only slightly longer than the width of strap 15 so that the strap 15 can glide easily through the slots 61 and 66 to prevent twisting or deformation of strap 15 which could otherwise cause the pulley to jam.

Referring to FIGS. 1, 3, 5 and 6, the length of matching curved raceways 31/43 is longer than the length of the first window 17 along its curved top edge 19 and bottom edge 20 and extends beyond the ends 19 and 20 of window 17. The length of the strap guide 51 along its curved edges 52 and 53 is greater than the length of the first window 17 along its curved top edge 19 and bottom edge 20 and shorter than the length of matching curved raceways 31/43.

Similarly, the length of matching curved raceways 32/42 is greater than the length of the second window 18 along its curved length and extends beyond the window 18 top edge 24 and bottom edge 23. The curve length of the strap guide 56 is greater than the curve length of the second window 18 and shorter than the length of matching curved raceways 32/42.

The strap 15 first passes through window 17 and then slot 61 in strap guide 51 on its way to pulley wheel 11. The relative lengths of the window 17, the raceways 31/43 and strap guide 51, together with the location of the slot 61, restrict the strap 15 from contacting the top edge 19 or bottom edge 20 of the window 17 by the automatic positioning of the strap guide 51 in response to the angle at which the strap 15 enters or leaves the housing 12.

Referring to FIGS. 1, 8 and 9, in one embodiment, strap guide 51 comprises an arcuate shell 59 having arcuate edges 52 and 53, a strap slot 61, and rails 54 and 55 disposed along the length of the arcuate edges 52 and 53. In operation, the rails 54 and 55 are disposed in the raceways 31 and 43 in which the guide 51 is able to move between the ends 33 and 34 of raceway 31 and ends 47 and 48 of raceway 43. The strap slot 61 is thickened and rounded around its periphery 67 to form a low friction surface for engagement of the strap 15 as it moves through the guide 51.

The strap guide 56, which is substantially identical to strap guide 51, comprises an arcuate shell 60 having arcuate edges 57 and 58, a strap slot 66, and rails 64 and 65 disposed along the length of the arcuate edges 57 and 58. In operation, the rails 64 and 65 are disposed in the raceways 32 and 42 in which the guide 56 is able to move between the ends 38 and 39 of raceway 32 and ends 44 and 46 of raceway 42. The strap slot 66 is thickened and rounded around its periphery 68 to form a low friction surface for engagement of the strap 15 as it moves through the strap guide 56.

Strap guides 51 and 56 are preferrable, but not necessarily, formed of a metal and/or durable plastic material with the slots 61 and 66 having smooth, rounded edges to create a low coefficient of friction with the strap 15 as it moves through the strap guides 51 and 56. Other suitable materials for guides 51 and 56 could include, without limitation, wood, stone, ceramic or other such materials.

Figure 7:
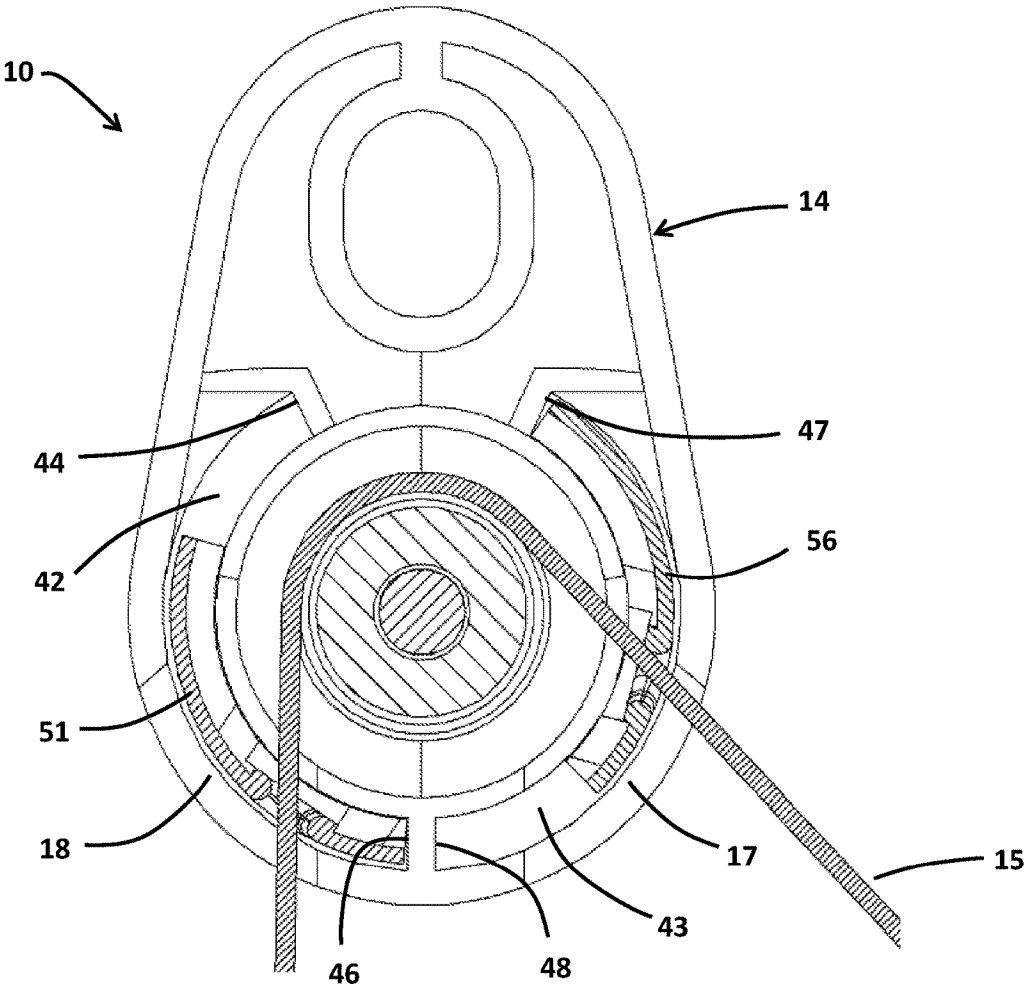
FIG. 7 is front view which is substantially the same as FIG. 5, with the addition of a flat strap and interior guides.

Referring to FIGS. 5, 6 and 7, the length of matching curved raceways 31/43 is greater than the length of the first window 17 along its curved length and extends beyond the window 17 top edge 19 and bottom edge 20. The curve length of the strap guide 51 is greater than the curve length of the first window 17 and shorter than the length of matching curved raceways 31/43.

Referring to FIGS. 5, 6 and 7, when entering or exiting window 17, the strap 15 passes through window 17 and slot 61 in strap guide 51 on its way to or from pulley wheel 11. The relative lengths of the window 17 between its top edge 24 and bottom edge 23, the raceways 31/43 and strap guide 51, together with the location of the slot 61 in strap guide 51, restrict the strap 15 from contacting the top edge 24 or bottom edge 23 of window 17 by the automatic positioning of the strap guide 51 in response to the angle at which the strap 15 enters or leaves the window 17.

Similarly, when entering or exiting window 18, the strap 15 passes through window 18 and slot 66 in strap guide 56 on its way to or from pulley wheel 11. The relative lengths of the window 18, the raceways 32/42 and strap guide 56, together with the location of the slot 66 in strap guide 56, restrict the strap 15 from contacting top edge 24 or bottom edge 23 of the window 18 by the automatic positioning of the strap guide 56 in response to the angle at which the strap 15 enters or leaves the window 18.

The strap 15 is kept substantially flat at all times within the housing 12 by the guides 51 and 56 and guide slots 61 and 66, respectively. The guides 51 and 56 further keep the strap 15 from engaging any of the edges of the housing windows 17 and 18 by the guides being positioned in the raceway as determined by the angle at which the strap enters the housing window and limited by the ends of the raceways 31/43 and 32/42. The relationship between the dimensions of windows, the guides, the slots and the raceways is such that the guides will be positioned in the raceways as a function of the angle in which the strap enters or exits the pulley but be limited from assuming a position in the raceways that would permit the strap to engage and chafe against any top or bottom edges of windows 17 or 18.

Figure 10:
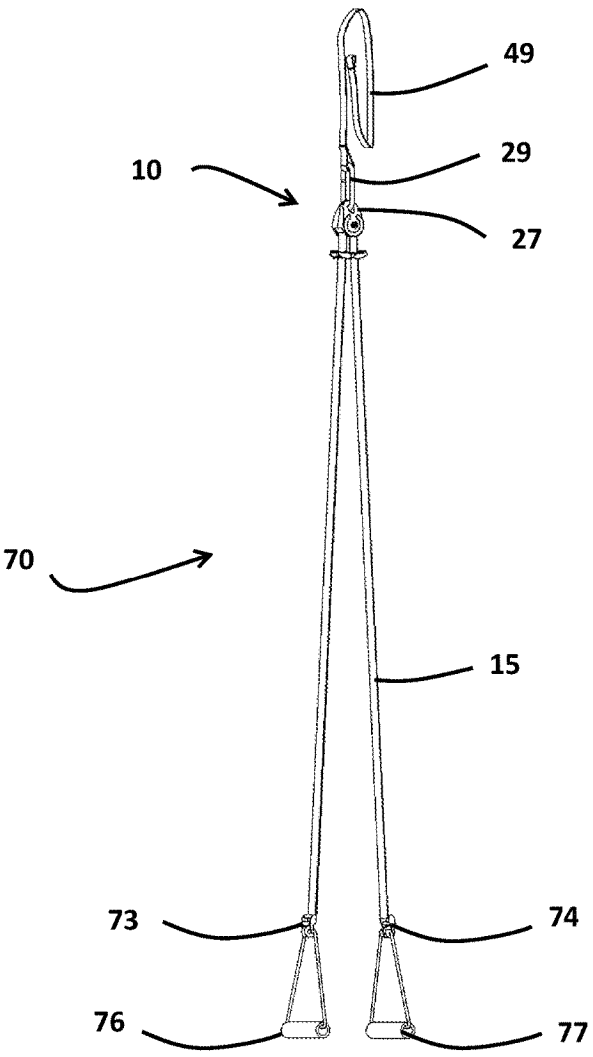
FIG. 10 is a front view of a flat strap exercise device including a pulley of the invention.

With reference to FIG. 10, while the pulley 10 has utility wherever a flat strap is used with a pulley, it has particular utility when used with a strap-based exercise device 70 having handles 76 and 77 (such as that described in U.S. Pat. No. 7,044,896). In such devices, the grips on the strap 15 are free to rotate and twist the strap during exercising.

If a prior art pulley in a housing having windows (not shown) is used with an exercise system such as exercise device 70 when in its normal use, the flat strap 15 is twisted; upon entering the housing, the flat strap will typically jam the prior art pulley and prevent further movement of the flat strap 15 through the prior art pulley. Also, in such prior art pulleys, if the strap enters the housing at certain angles, the strap will be forced against the edge of the housing window where it will be worn and eventually compromised.

As described above, these deleterious events are avoided by the pulley 10 of the present invention.

It is to be understood that this invention is not limited to those embodiments and modifications described in the specification. Modifications and variations can be made by one skilled in the art without departing from the sprit and scope of the invention. Moreover, any one or more features of any embodiment of the invention may be combined with any one or more other features of any other embodiment of the invention, without departing from the scope of the invention.

What is claimed is:

1. A pulley for support of a flat strap including a pulley wheel enclosed within a housing having a first window having edges and a length between its edges and a second window having edges and a length between its edges, said pulley comprising:

a first guide moveably supported in the housing adjacent the first window;

a second guide moveable supported in the housing adjacent the second window;

a first raceway in the housing wherein the first raceway has two ends and a length between the two ends and supports the first guide which is movable in the first raceway between the two ends of the first raceway, wherein the first guide has a top edge and bottom edge that are disposed in the first raceway and a length between the top edge and the bottom edge, and wherein the first raceway length is greater than the first guide length; and a second raceway in the housing wherein the second raceway has two ends and a length between the two ends and supports the second guide which is movable in the second raceway between the two ends of the second raceway, wherein the second guide has a top edge and a bottom edge that are disposed in the second raceway and a length between the top edge and the bottom edge, and wherein the second raceway length is greater than the second guide length, wherein the flat strap passes through the first guide and the second guide as it passes in and out of the housing, wherein the length of the first window between its edges is less than the length of the first guide and the first slot is located on the first guide such that the first slot cannot be disposed beyond the edges of the first window regardless of the position of the first guide in the first raceway whereby the flat strap is prevented from contacting the edges of the first window, and wherein the length of the second window between its edges is less than the length of the second guide and the second slot is located on the second guide such that the second slot cannot be disposed beyond the edges of the second window regardless of the position of the second guide in the second raceway, whereby the flat strap is prevented from contacting the edges of the second window.

2. The pulley of claim 1 further comprising:

a first slot in the first guide; and a second slot in the second guide;

wherein the flat strap passes through the first slot and the second slot as it passes in and out of the housing.

3. The pulley of claim 2 wherein the first slot and the second slot are both the same shape and are both slightly larger than the flat strap.

4. The pulley of claim 3 wherein the first slot and the second slot each have edges, and the edges are shaped to provide a low friction surface.

5. The pulley of claim 1 wherein the first guide, the second guide, the first raceway, the second raceway each have an arcuate shape.

6. The pulley of claim 1 further comprising:

a housing connection member that supports the housing and permits it to move in space.

7. The pulley of claim 6 wherein the housing connection is a swivel.

8. The pulley of claim 1 further comprising:

a first locking cam buckle larger than the first window disposed on the flat strap that extends from the first window; and a second locking cam buckle larger than the second window disposed on the flat strap that extends from the second window.

9. The pulley of claim 8 where the flat strap is a component of an exercise device.

10. The pulley of claim 1 wherein the guides are formed from any one of metal, durable plastic, wood, stone, or ceramic.

* * * * *